United States Patent [19]

Gerrans

[11] 4,075,087

[45] Feb. 21, 1978

[54] CONTINUOUS GRADER FOR FRUITS OR THE LIKE

[75] Inventor: Alfred W. Gerrans, San Jose, Calif.

[73] Assignee: Sunsweet Growers, Inc., Stockton, Calif.

[21] Appl. No.: 622,407

[22] Filed: Oct. 14, 1975

Related U.S. Application Data

[63] Continuation of Ser. No. 366,624, June 4, 1973, abandoned.

[51] Int. Cl.[2] ..... B07B 1/15

[52] U.S. Cl. ..... 209/99

[58] Field of Search ..... 209/99, 107, 101, 73

[56] References Cited

U.S. PATENT DOCUMENTS

| | | | |
|---|---|---|---|
| 1,056,369 | 3/1913 | Ritchie | 209/99 |
| 2,432,235 | 12/1947 | Grimes | 209/99 X |
| 3,211,289 | 10/1965 | Brumagin | 209/99 |
| 3,347,368 | 10/1967 | Mogensen | 209/99 |
| 3,701,418 | 10/1972 | Chapman | 209/99 |
| 3,799,336 | 3/1974 | Holman | 209/99 |

*Primary Examiner*—Allen N. Knowles
*Attorney, Agent, or Firm*—Paul B. Fihe

[57] ABSTRACT

A continuous grader for fruits or the like including a unit having a plurality of aligned V-troughs and projecting fingers secured to the terminal end of a shaker table across which the fruit moves in a single layer.

8 Claims, 5 Drawing Figures

Fig-2
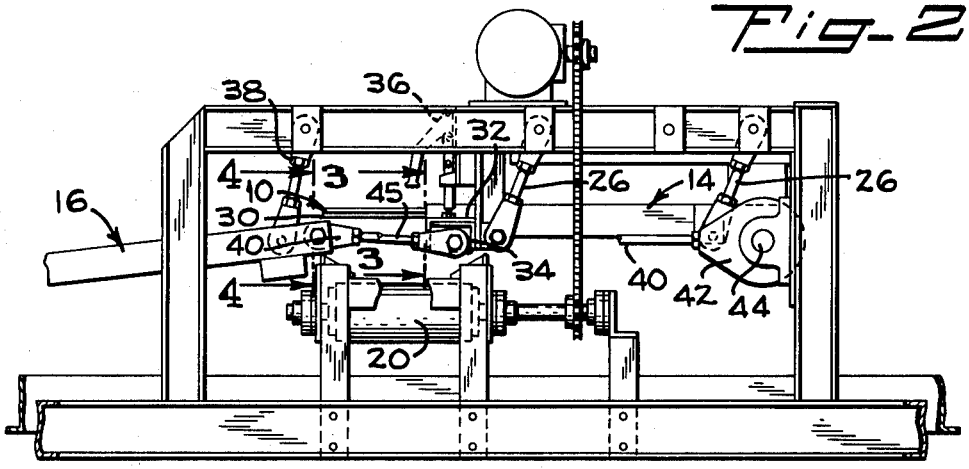
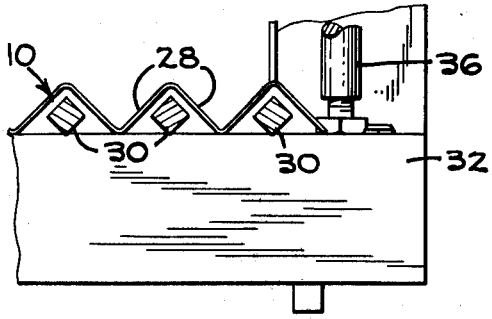
Fig-3
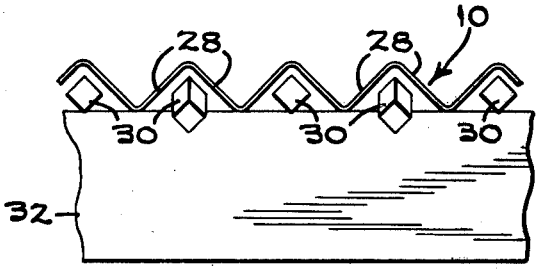
Fig-4
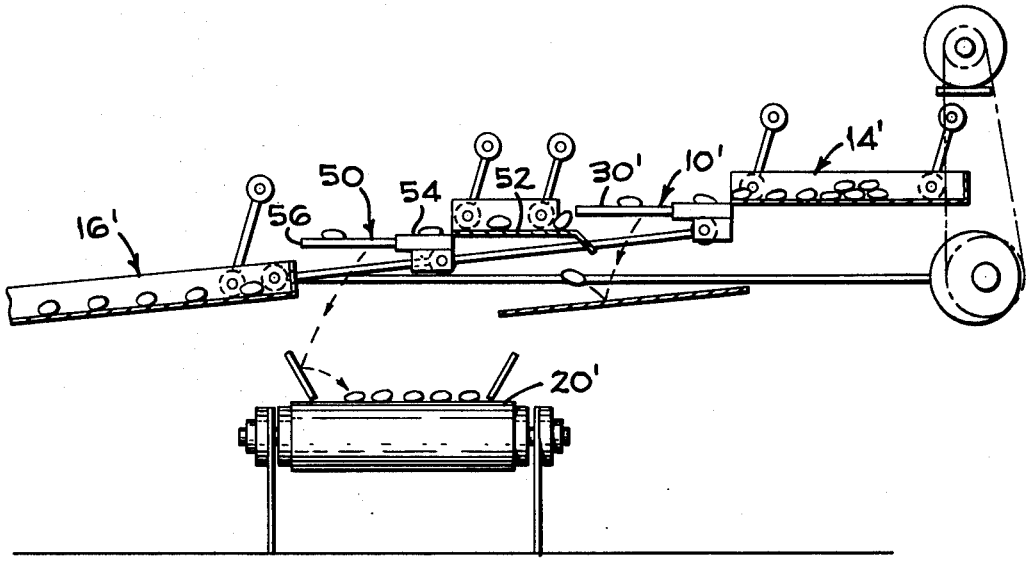
Fig-5

CONTINUOUS GRADER FOR FRUITS OR THE LIKE

This is a continuation of application Ser. No. 366,624, filed June 4, 1973, now abandoned

FIELD OF THE INVENTION

The present invention relates generally to the grading of articles according to size, and more particularly, to a continuous grader for fruits and vegetables or other articles wherein certain variances not only in size but also in shape naturally occur.

BACKGROUND OF THE INVENTION

Farmers are, of course, aware of the general difficulties of grading fruits and vegetables because of the individual variances in the size and shape thereof together with the presence of extraneous unwanted material such as twigs, stems, leaves and similar chaff. The problem is yet more aggravated because of the requisite high production rates in the harvesting and processing of many fruits and vegetables because of the short harvesting period. By way of specific example, ripened prune plums conventionally referred to as "green fruit" are now conventionally shaken from the tree by some form of vibratory shaker so as to drop to the receiving surface of an underlying harvester unit whereon the green fruit are accummulated on a conveyor and delivered to a large box for storage and transportation. The green fruit in the box together with some twigs and stems and leaves dislodged by the shaking operation are then delivered to a processing plant wherein the green fruit is initially distributed in a single layer on a plurality of trays, for example, by mechanism such as shown and described in U.S. Pat. No. 3,107,800 issued Oct. 22, 1963, to Alfred W. Gerrans. One such unit is capable of handling green fruit at rates in excess of 30 tons per hour and ultimately delivers a stack of trays, each carrying a single layer of the green fruit, to a tunnel dehydrator wherein the exposure of the fruits to hot moving air over a predetermined period reduces the water content so that the dried prunes emerge preparatory to packaging and delivery to retail outlets. Conventionally, immediately prior to packaging, the dried prunes are graded so that individual retail packages contain different size fruit. However, the harvesting and processing operations have not discriminated against grossly undersized fruit which is considered unacceptable to the retail market, and a large amount of the dried fruit, frequently approximately 20% or more of the total must be discarded. This represents a substantial loss in terms of the labor of harvesting and processing as well as the heat energy expended in the dehydration operation and the extra capital expenditure and equipment maintenance necessary to process fruit having substantially no ultimate value. To indicate the practical significance of the problems, typical dehydration costs alone for a pound of prunes are approximately two cents. Accordingly, if we assume a typical yearly fruit harvest of 450 thousand tons and that 20% thereof is undersized fruit, a simple calculation will indicate that a yearly expenditure of $3,600,000.00 is required for drying of fruits which are subsequently discarded. In addition, the ecological problem of disposal is not of minor significance.

SUMMARY OF THE PRESENT INVENTION

Accordingly, it is the general objective of the present invention to provide a continuous grader for fruits and vegetables or other articles which is capable of ready incorporation in existing harvesting and/or processing equipment and furthermore is capable of performing the grading operation at a high rate so as not to create a bottleneck in the established high rate of fruit or vegetable handling and processing. Generally, the continuous grading operation can be incorporated at various locations in harvesting or processing operations whereat the fruit or vegetables are being moved. By way of example, in the case of ripe prune plums, there exist locations both in the harvesting and pre-dehydration processing operations whereat the green fruit is being moved in a single layer over a substantially planar surface, and in this case, it is merely necessary to provide a grading extension of this surface in the form of a plurality of laterally spaced fingers which project from the surface so as to conduct fruits in rows therebetween. Dependent upon the particular spacing of the fingers, undersized fruit will drop therebetween for appropriate disposal leaving fruits above the predetermined minimum size on the fingers for continued movement thereacross to a subsequent processing operation. Several distinct characteristics of the finger arrangement permit the incorporation of the grading mechanism without interfering with the desired high rate of production. In the first place, the fingers are supported only at their input end so that their free projecting discharge ends neither present obstruction to the free motion of the fruit, nor permit an accumulation of leaves, stems or other debris, the arrangement being substantially self-cleansing. Additionally, the fingers are formed in a particular cross-sectional configuration so as to perform a precise grading operation, but on the other hand prevent extensive area contact with the fruit which in some cases may be very ripe and sticky so that the frictional resistance to fruit motion is minimized. Basically, this is achieved by defining the grading opening by rectilinear edges of the fingers as opposed to a curved surface which would allow such undesired, extensive contact. By way of example, the cross-sectional configuration of the fingers can be rectangular with the closest spacing between adjacent fingers being defined by corners of the rectangles. In addition, adjacent fingers are preferably disposed in slightly divergent dispositions relative to a vertical direction so that as the fruits move across the fingers, a slight enlargement of the opening exists so that no jamming or excessive frictional resistance resultant from a convergent finger disposition is possible even if, inadvertently, a slight bending of the fingers is experienced. Finally, the total finger length is limited so that the total restriction to free fruit flow is minimized, and in accordance with one alternate embodiment of the invention, if sufficient separation of undersized fruits is not achieved by a single set of fingers, such first set can be arranged to discharge the fruits onto a second set of fingers after additional forward impetus has been obtained so that excessive restriction to fruit flow is avoided but substantially complete separation of undersized fruits from those above the predetermined minimum size is attained.

Preferably, before the fruits arrive on the described fingers, orienting means in the form of parallel V-troughs are interposed between the planar surface and the fingers so as to orient the ovoid fruits so that their longer major axis is substantially parallel to the direction of fruit flow and as a consequence, upon arrival of the fruits on the fingers, undersized fruits will immediately drop therebetween thus not only to expedite the grading operation, but also to reduce the total frictional resistance to fruit motion because of the permitted reduction in the total length of the fingers.

Specifically, in the case of a tray loader such as described in the previously mentioned U.S. Pat. No. 3,107,800 wherein prune plums are delivered to an existing shaker table from a supply hopper for subsequent delivery in a single layer onto the flat drying trays, the invention can readily be embodied by mounting the V-troughs and the grader fingers in forward freely projecting dispositions at the extremity of such shaker table which itself provides the planar surface arranged to conduct the fruit thereacross in a single layer. Preferably, the fingers and interposed V-troughs are mounted directly on such shaker table so as to experience the same vibratory motion delivered to such shaker table by the existing table vibrating means normally in the form of an eccentrically-actuated rod. A transversely extending conveyor is mounted underneath the fingers so that all undersized fruits which drop between the fingers are received on such conveyor and are thus delivered to a disposal receptacle at one side of the equipment. On the other hand, the fruits above the desired minimal size which move across the entire length of the fingers are delivered onto another shaker table which, in turn, delivers the desired graded fruits in a single layer onto the trays preparatory to the subsequent drying or dehydration operation.

BRIEF DESCRIPTION OF THE DRAWINGS

The stated objective of the invention and the manner in which it is achieved as summarized hereinabove will be more readily understood by reference to the following detailed description of the exemplary embodiments of the invention shown in the accompanying drawings wherein:

FIG. 2 is a side elevational view of the FIG. 1 structure as viewed from the left thereof, FIG. 3 is an enlarged fragmentary sectional view taken along lines 3—3 of FIG. 2, illustrating the manner of releasably attaching the grading mechanism, FIG. 4 is another enlarged fragmentary sectional view taken along line 4—4 of FIG. 2, illustrating the configuration and disposition of the ends of the grading fingers, and FIG. 5 is a diagrammatic side elevational view of a modified embodiment of the invention incorporating two sequentially operable grading mechanisms.

DETAILED DESCRIPTION OF THE EXEMPLARY EMBODIMENTS OF THE INVENTION

Figure 1:
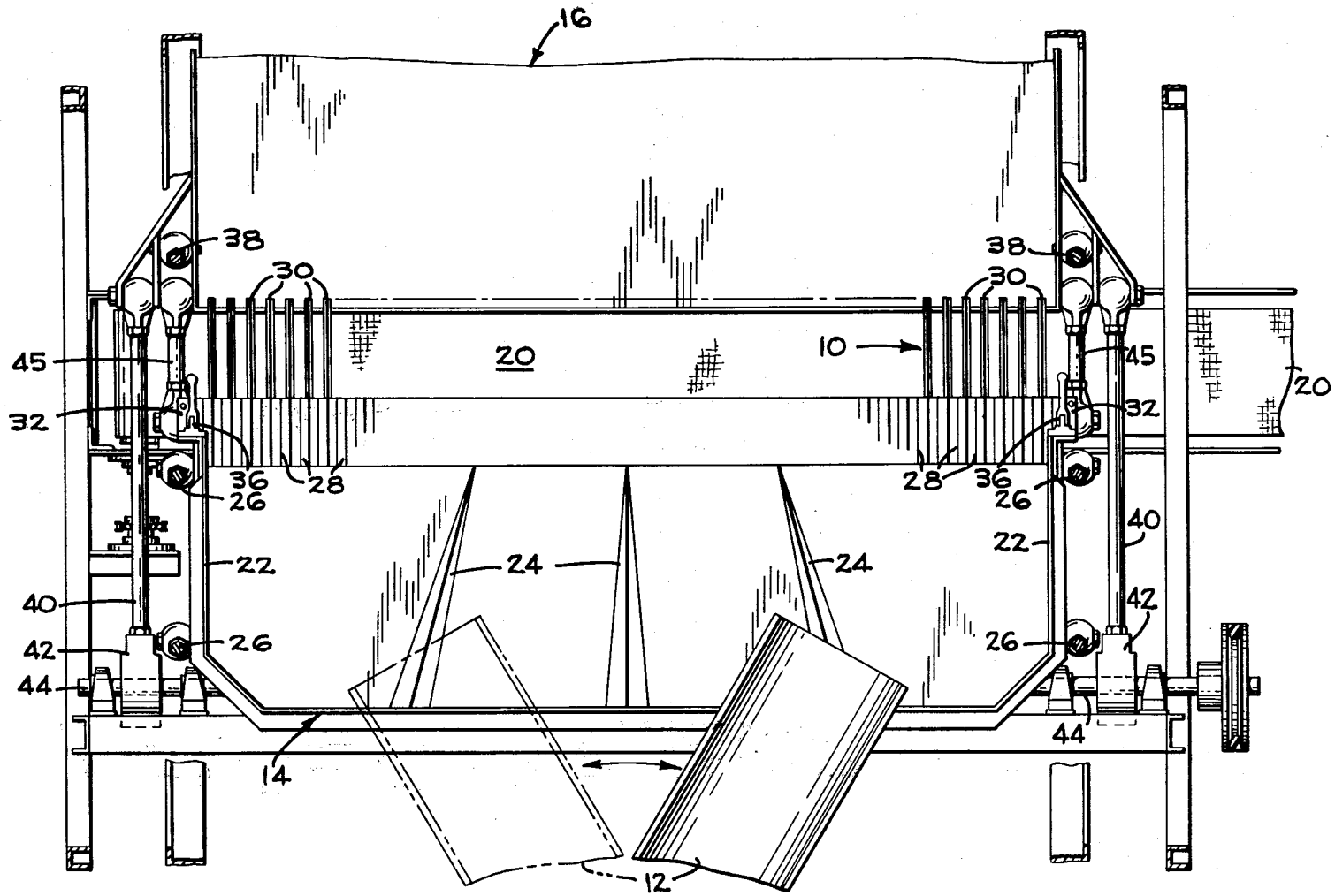
FIG. 1 is a top plan view of a continuous grader incorporated in a tray loading unit for prune plums, portions of the structure being broken away to illustrate additional details.

With initial reference to FIGS. 1 and 2, a continuous grader, indicated generally at 10, embodying the present invention is incorporated in a piece of equipment such as shown in the mentioned U.S. Pat. No. 3,107,800 arranged to load drying trays with a single compact layer of green fruit in the form of ripe prune plums. More particularly, a conventional feeding device diagrammatically indicated at 12 in FIG. 1 is arranged to distribute the green fruit evenly across a first shaker table 14 supported thereunder which generally provides a substantially planar surface across which the fruits are conducted to the left, as viewed in FIG. 2, and thereafter across the grader mechanism 10 which separates the undersized fruit from the desired fruits above a minimum size, which latter are then discharged onto another shaker table 16 for continued motion to the left and ultimate discharge onto the trays delivered in sequence from left to right on a suitable conveyor belt which extends longitudinally of the apparatus under the shaker tables 14, 16 as shown in the previously mentioned U.S. Pat. No. 3,107,800. Generally, the undersized fruits are deposited on a transverse belt conveyor 20 located under the grader 10 so as to conduct the undersized fruits to the side of the equipment for discharge into disposal receptacles (not shown).

More particularly, the first shaker table 14 provides generally a flat surface which, however, includes side walls 22 and three intermediate partitions 24 extending generally in the direction of fruit motion so as to establish and maintain the fruits in evenly distributed transversely spread relationship thereon. At its four corners, the shaker table 14 is suspended at the lower ends of pivot arms 26 which permit an accurate to and fro motion of the shaker table when energized by a vibrator means to be described in detail hereinafter. As illustrated in FIG. 2, the arms 26 are resting in their intermediate or neutral position and the imparted to and fro motion is such that the shaker table 14 moves upwardly as it moves forward and thence downardly in its rearward motion, such action being known to effect an even distribution of the fruits on the shaker table and an advance thereof to the left, as previously mentioned.

The grader mechanism 10 is releasably attached to the discharge or left edge of the shaker table 14 as shown in FIG. 2 so as to partake of the same vibratory motion and is formed to provide a series of parallel V-troughs 28 which receive the fruits flowing from the discharge end of the shaker table 14 so as to align the moving fruits in a series of parallel rows. Because of the generally ovoid configuration of individual fruit, the vibratory motion of the V-troughs 28 will also effect an orienting function so that the longitudinal stem axis of the fruits will become generally aligned with the direction of fruit motion through such troughs. The grader 10 also includes a plurality of fingers 30 whch are secured to the discharge ends of the V-troughs 28, and more particularly, are centrally aligned with the peaks between the troughs so that the space between adjacent fingers is aligned with the valley of the adjacent trough and accordingly will receive the forwardly advancing fruit rows. Preferably, as best illustrated in FIG. 4, each finger 30 has a square cross-section with one diagonal of the square in substantially a vertical plane so that the transverse diagonal of each finger is in turn in a substantially horizontal disposition. Accordingly, the space between the fingers 30 which defines the grading dimension, is formed by the two linear corners or edges of adjacent fingers. These linear edges provide an accurate grading dimension and moreover minimize the resistance to the passage of fruit over the fingers 30 so that no build up or accumulation of fruits because of frictional retardation is experienced. Furthermore, in the direction of fruit motion, a slight opening or divergence of the linear edges of the fingers is obtained through the expedient of imparting a slight bend to each alternate finger in a downward direction, as is clearly illustrated in FIG. 4, whereupon even if the free projecting end of the projecting finger is slightly bent, as may happen in practical operation, no convergence of fingers will be obtained which would result in a jamming of the fruits.

In addition, since the fingers 30 are supported only at the trough ends and project freely therefrom, no structure is present to allow the accumulation of any leaves or other extraneous material which would interfere with the proper advance of the fruit. Thus, the specifically described finger arrangement can be considered as self-cleansing and as providing minimum frictional resistance to the flow of fruits thereover.

As previously mentioned, the described grader unit 10 is releasably connected to the shaker table 14 so that it can be removed for repair or replacement with a grader having different finger spacing when a variation in minimum acceptable fruit size is desired. For this purpose, the fingers 30 and V-troughs 28 are mounted as an integral unit on an underlying section of angle iron 32 which is received on a transverse frame member 34 of the shaker table 14. A manually operable clamp 36 on each side of the grader unit 10 is arranged to releasably clamp the extremity of the angle iron section 32 to the frame member, thus allowing ease of replacement when desired.

The graded fruits which pass over the grader fingers 30 drop onto the mentioned second shaker table 16 for ultimate delivery in a single layer onto the trays, as discussed in detail in the prior U.S. Pat. No. 3,107,800. Briefly, this table 16 is supported at a slight downward inclination on pivot arms such as indicated at 38 and vibratory motion is imparted thereto by pivoted connecting rods 40 joined to its sides and at their opposite ends to eccentrics 42 on a shaft 44 driven by a suitable electric motor (not shown).

A short connecting rod 45 is connected at each side between the second table 16 and the first table 14 and the grader unit 10 thereon so the vibratory motion is also imparted to the latter.

Undersized fruit which drop between the fingers 30 are received on the mentioned conventional belt conveyor 20 which extends transversely of the machine immediately under the grader fingers 30 so as to be discharged at the side of the machine into a suitable receptacle (not shown).

For installation in the tray loader as mentioned herein, the V-troughs 28 need be no more than six inches in length to achieve the orienting function and the fingers 30 themselves are preferably no more than ten inches in length which is sufficient to remove approximately 90% of undersized fruits without creating any reduction in the desired high rate of production. In the tray loader installation, a grader of the type described having a transverse dimension of no more than six feet is capable of performing the grading operation on green fruit delivered thereto at the rate of thirty tons per hour.

Because of the noted resistance in the passage of fruits across the fingers, it is impractical to increase their lengths without a substantial reduction in the rate of fruit flow thereacross, but if an approach to 100% removal of undersized fruits is desired, a second, sequential grader unit 50 as diagrammatically illustrated in FIG. 5 can be utilized. An initial shaker table 14' and grader unit 10', as described in the first embodiment of the invention is also utilized in this second embodiment and corresponding parts will be indicated by like reference numerals with an added prime notation for differentiation. The second grader unit 50 is arranged to receive fruits discharged from the ends of the fingers 30' of the first grader unit and includes a short shaker table section 52 conjoined to V-troughs 54 and projecting fingers 56 whose structure and operation are substantially identical to that of the first grader unit so that detailed description thereof will not be repeated. Undersized fruits from both grader units 10', 50 will be discharged onto an underlying transverse belt conveyor 20' and fruits above the desired minimal size will in turn be delivered from the second grader unit 50 onto an additional shaker table 16' which effects discharge of the fruits onto the drying trays in a single, compact layer, as described hereinbefore.

Various other modifications and/or alterations in the two described structures can be envisioned without departing from the spirit of the invention, and in particular, it will be obvious that either of the embodiments can readily be incorporated in harvesting equipment or in other locations whereat prunes are being handled in quantities. Accordingly, the foregoing description of two particular embodiments is not to be considered in a limiting sense and the actual scope of the invention is to be indicated only by reference to the appended claims.

What is claimed is:

1. A continuous grader for fruits or the like which comprises, means forming substantially a planar surface arranged to conduct fruit thereacross in substantially a single layer, a plurality of laterally spaced fingers arranged to receive fruits from said planar surface and to conduct fruits above a predetermined size in rows between said fingers, undersized fruit dropping between the fingers so as to be continuously separated from the lager fruits during their advance, the closest surfaces of adjacent fingers constituting substantially linear edges, and a plurality of V-troughs interposed between said planar surface and said fingers to orient the fruits passing therebetween.

2. A continuous grader according to claim 1 wherein adjacent fingers diverge vertically in the direction of fruit advance.

3. A continuous grader according to claim 1 wherein said fingers each have a rectangular cross-section and the corners of the rectangles defined by adjacent fingers constitute the minimal spacing therebetween.

4. A continuous grader according to claim 1 which comprises fruit conveying means disposed below said fingers for receiving and conveying undersized fruits dropped between said fingers.

5. A continuous grader according to claim 1 which comprises a second plurality of laterally spaced fingers arranged to receive and conduct thereacross fruits discharged from the end of said first plurality of fingers.

6. A continuous grader for fruits or the like which comprises, a shaker table, vibrating means connected to said table whereby fruits received thereon en masse are conducted thereacross in a predetermined direction and in substantially a single layer, and a plurality of fingers connected to the discharge end of said shaker table in predetermined laterally spaced relation to conduct the fruits thereacross in single rows so that undersized fruits drop between said fingers, the closest surfaces of adjacent fingers constituting substantially linear edges.

7. A continuous grader according to claim 8 which comprises a plurality of V-troughs connected to said shaker table in interposed relation between it and said fingers.

8. A continuous grader according to claim 7 wherein said fingers and said V-troughs constitute a unit releasably connected to said shaker table.

* * * * *